US007549636B2

(12) United States Patent
Schmid et al.

(10) Patent No.: US 7,549,636 B2
(45) Date of Patent: Jun. 23, 2009

(54) SYSTEM AND METHOD FOR EJECTING PRINT MEDIA FROM A MOVEABLE SHUTTLE

(75) Inventors: Geoffrey Schmid, San Diego, CA (US); Jonathan Olson, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 11/888,286

(22) Filed: Jul. 31, 2007

(65) Prior Publication Data

US 2009/0033025 A1 Feb. 5, 2009

(51) Int. Cl.
*B65H 29/54* (2006.01)

(52) U.S. Cl. ..... 271/308; 271/267; 271/194

(58) Field of Classification Search ..... 271/267, 271/276, 194, 84, 307, 308, 312; 347/101, 347/104, 16

See application file for complete search history.

(56) References Cited

U.S. PATENT DOCUMENTS 4,033,694 A 7/1977 Ferrari
4,043,665 A 8/1977 Caldwell
4,825,255 A 4/1989 Iaia, Jr. et al.
4,831,419 A 5/1989 Iaia, Jr. et al.
5,216,442 A 6/1993 Parks et al.
6,371,430 B1 4/2002 Vernackt
6,460,991 B1 10/2002 Temple et al.
6,604,623 B2 8/2003 Sumi et al.
6,682,191 B2 * 1/2004 Temple et al. ..... 347/104
6,834,949 B2 12/2004 Greive
7,168,698 B2 1/2007 Kawamura et al.
2006/0261536 A1 * 11/2006 Dangelewicz et al. ..... 271/90

FOREIGN PATENT DOCUMENTS

JP P2003/76032 A 3/2003

* cited by examiner

*Primary Examiner*—Patrick H Mackey
*Assistant Examiner*—Gerald W McClain

(57) ABSTRACT

In one embodiment a media ejection system is disclosed for a printer having a stationary print head and a moveable shuttle configured to hold print media via vacuum pressure while moving the print media past the print head. The media ejection system includes a vacuum release valve, actuable to release vacuum pressure in the shuttle, and a lifter, coupled to the vacuum release valve. The lifter is actuable to mechanically lift the print media from the shuttle, and to simultaneously open the vacuum release valve. In another embodiment, a method for ejecting print media from a moveable shuttle is disclosed. The method includes mechanically lifting the print media from the shuttle and simultaneously substantially equalizing pressure above and below the print media.

19 Claims, 6 Drawing Sheets

SYSTEM AND METHOD FOR EJECTING PRINT MEDIA FROM A MOVEABLE SHUTTLE

BACKGROUND

The present disclosure relates generally to inkjet printing systems. In some types of inkjet printers the imaging system is held stationary while the print media is held on a shuttle plate or platen and swept through the printzone. This type of system offers some speed advantages over some other printers that move both the inkjet pens and the media. However, this architecture requires that the media be held down upon a shuttle plate in order to maintain accurate PPS (pen to paper spacing) and accurate control of the media.

The print media is often held to the shuttle plate by vacuum pressure. When the printing operation is complete, the media is ejected from the shuttle plate using mechanical rockers. In order to eject the print media from the shuttle plate, the rockers must overcome the downward vacuum pressure force exerted upon the media. For larger media sizes, this force can become quite large (since force equals pressure times area) and cause the rockers to deflect. In such cases the media may end up breaking the vacuum and lifting off the plate, but the stored energy in the rockers can cause a slingshot effect, which causes loss of control of the media and can ultimately lead to media jams.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
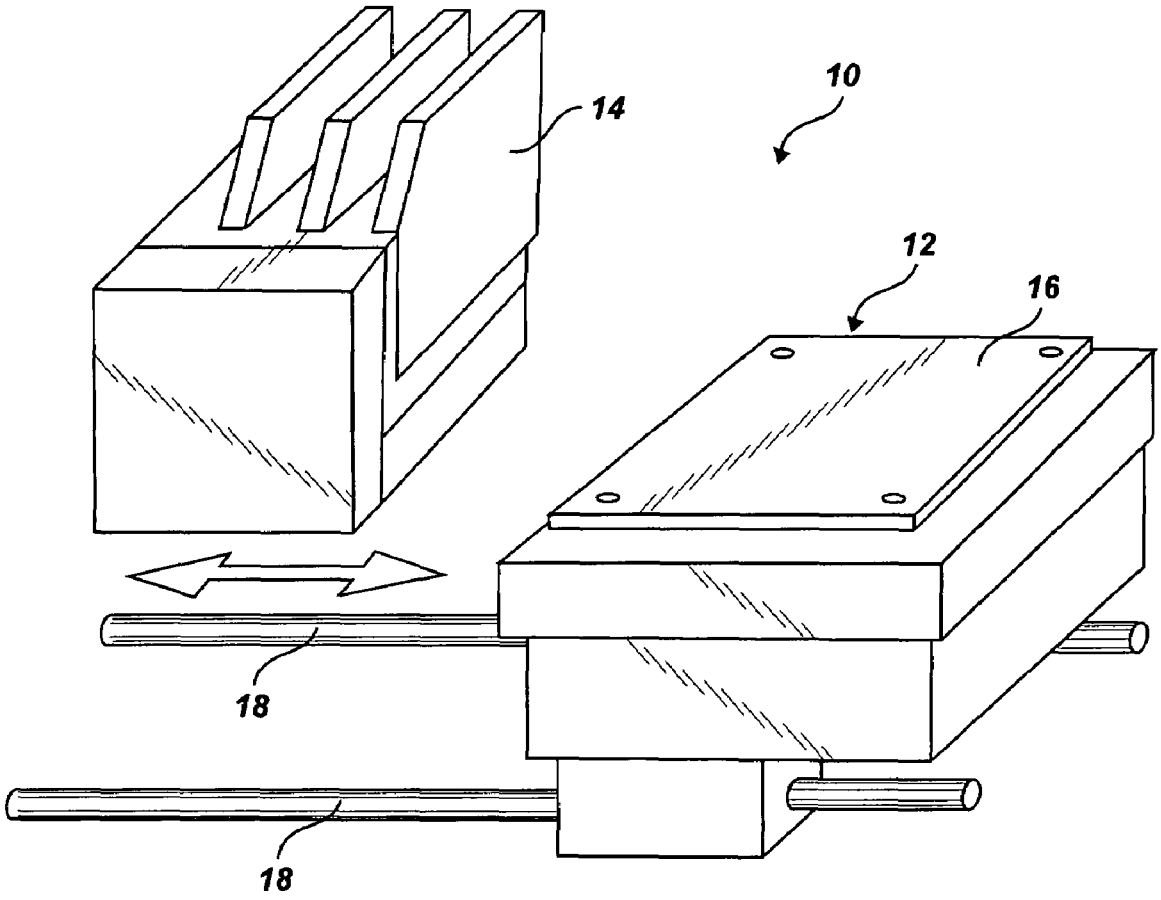
FIG. 1 is a perspective view of a portion of an ink jet printer having a moveable shuttle plate and stationary print heads.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

The present disclosure relates generally to inkjet printing systems, particularly those in which the imaging system is held stationary and the print media is swept through the printzone. An example of this type of printing system is shown in FIG. 1. The printing system 10 includes a moveable shuttle plate assembly 12, and stationary printheads 14. The shuttle plate assembly includes a shuttle plate 16, and is configured to translate below the printheads 14 along guide rods 18, so that ink can be applied to the print media (not shown in FIG. 1) that is positioned atop the shuttle plate. This type of printing system typically also includes a media pick system (not shown) for picking a single piece of print media from a supply of media sheets and positioning the print media upon the shuttle plate. The system will also include an off-loader system (not shown) for taking completed sheets of print media from the shuttle plate region and dispensing them from the printing system.

Figure 2:
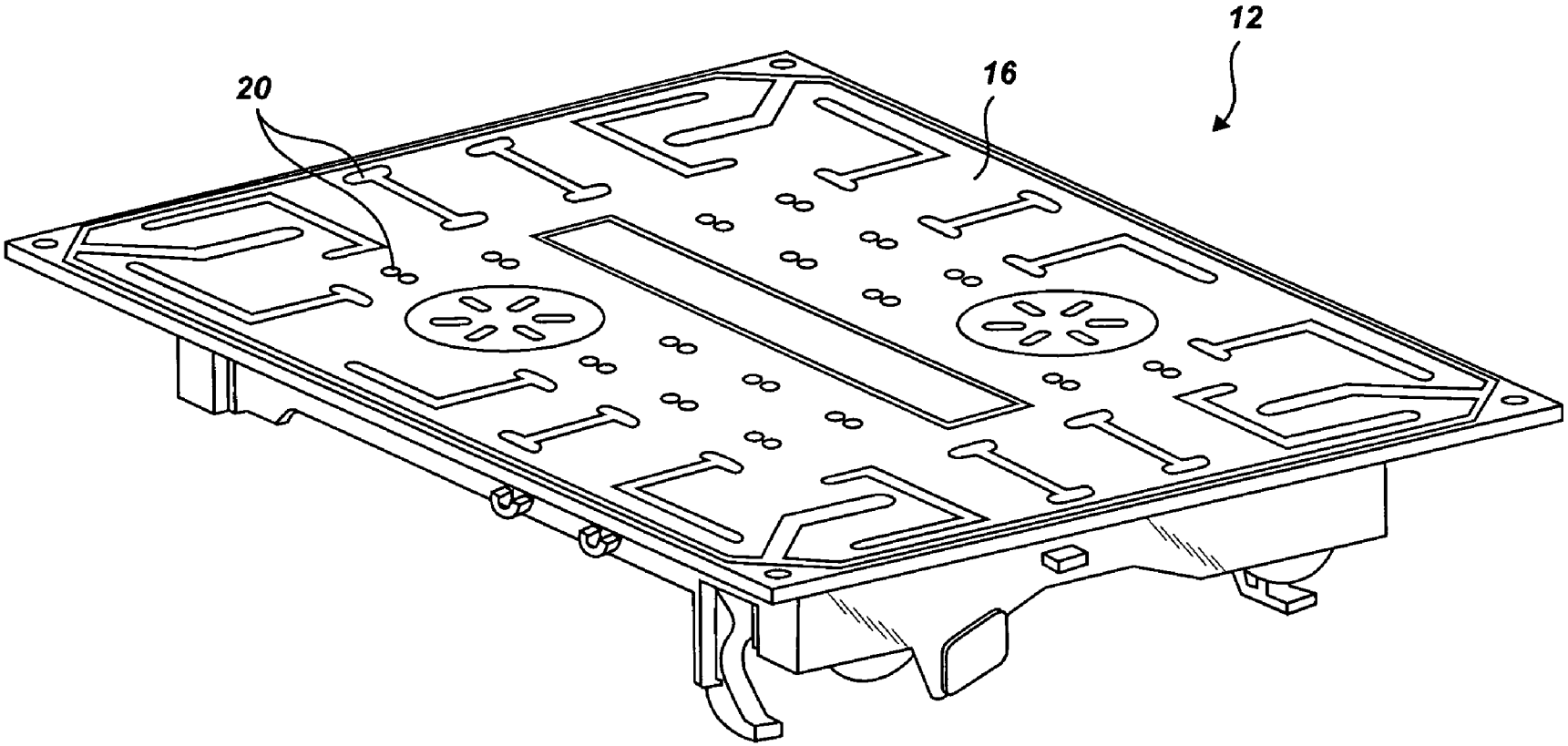
FIG. 2 is a perspective view of a shuttle plate assembly that can be used in the ink jet printing system of FIG. 1.

In these types of systems the print media is frequently held down upon the shuttle plate 16 by vacuum pressure. A closer perspective view of a portion of the shuttle plate assembly 12 is shown in FIG. 2. The shuttle plate can include vacuum passageways 20 that are interconnected to a vacuum pump system (not shown) that draws air through the vacuum passageways to hold the media upon the shuttle plate. When a sheet of print media is placed upon the shuttle plate over the vacuum passageways, atmospheric pressure will hold the media against the shuttle plate. As can be appreciated from the figure, the shape and position of the vacuum passageways can vary.

Figure 3:
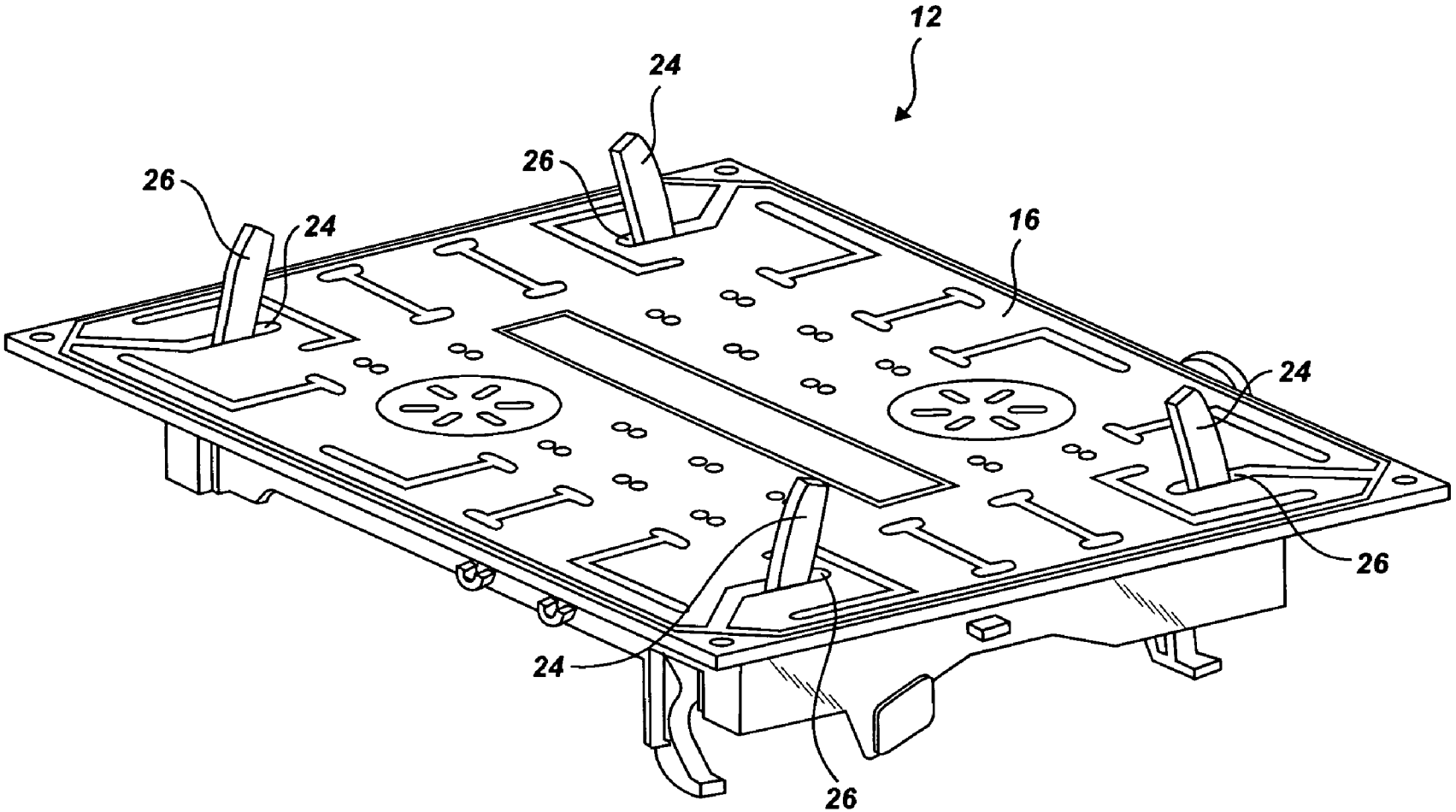
FIG. 3 is a perspective view of the shuttle plate assembly of FIG. 2, with the ejection rockers in the fully extended position.

When the printing operation is complete, the print media is ejected from the shuttle plate 16 using a mechanical device, such as mechanical rockers. Shown in FIG. 3 is a perspective view of the shuttle plate assembly 12 with the distal ends 22 of four ejection rockers 24 fully extended through corresponding rocker apertures 26. While four ejection rockers are shown in FIG. 3, it is to be appreciated that different numbers of ejection rockers can be used. It is also to be appreciated that while pivoting rocker arms are shown and described as one mechanism for lifting the print media from the shuttle plate, a variety of other media lifting mechanisms could be employed. For example, the media lifting mechanism could use linearly telescoping (rather than pivoting) lifters. Alternatively, solid posts that rise and fall using a rack and pinion system could also be used to push the media up off of the shuttle plate. Many other lifter mechanisms can also be used. Additionally, it should be appreciated that the media lifting system can be configured to lift the media in different ways than that shown and described herein. For example, rather than lifting the media to a position above and substantially parallel to the shuttle plate, as shown in the figures, the lifting system could be configured to lift and angularly tip the media to facilitate its entry into a media offloading device. Many different media lifting devices and configurations can be used to provide a media ejection system in accordance with the present disclosure.

In order to eject the print media from the shuttle plate 16, the rockers 24 must overcome the downward vacuum force exerted upon the print media. For larger media sizes, this force can become quite large and cause the rockers to deflect when they are caused to press up against the print media. For example, for a piece of 5"×7" print media and a vacuum pressure of about 4.3 psi, the total hold-down force can be about 135 pounds. In such cases the media may end up breaking the vacuum and lifting off the plate, but the stored energy in the rockers can cause a slingshot effect, which can cause loss of control of the media and can lead to media jams in the offloading system (not shown, mentioned above).

Some possible approaches to this problem include lowering the overall system vacuum pressure by throttling the vacuum supply system, or by adding a vent to atmosphere inside the manifold. This approach can reduce the overall hold-down strength and reliability of the media handling mechanisms, and can result in media transfer errors. Moreover, a reduced vacuum approach may not provide sufficient strength to suck down "curled", or cockled media. Another possible approach is to temporarily turn off the vacuum supply system when it is desired to eject the media. This, however, can be difficult to time precisely, and can require additional cycle time to actuate a valve or turn off a vacuum pump to vent the manifold.

The inventors have developed a system in which vacuum pressure in the manifold is vented simultaneously with lifting of the media. This lowers the lifting force required by the rockers and results in smooth media ejection. Several side views of one embodiment of a media shuttle plate assembly 12 having a rocker actuated vacuum relief valve system are shown in FIGS. 4-7. This system generally includes a vacuum manifold 30 and a vacuum release valve 32 that are located below the shuttle plate 16. The vacuum passageways 20 and the vacuum release valve are all in fluid communication with the vacuum manifold, which in turn communicates with a vacuum pump system (not shown). A drive rocker 34 is pivotally linked to the proximal end 36 of each ejection rocker 24, and has a lever arm 38 that is connected to a rocker drive mechanism (e.g. a leadscrew assembly, not shown).

Figure 4:
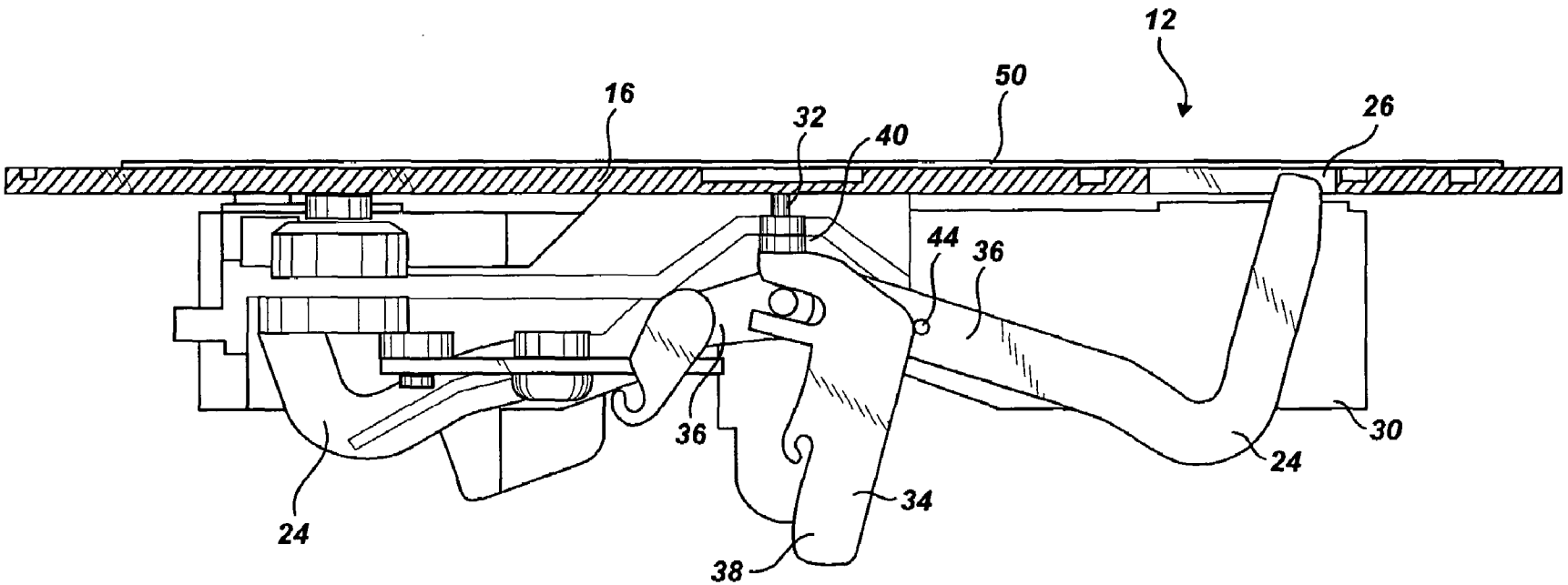
FIG. 4 is a side view of the shuttle plate assembly of FIG. 2, showing the ejection rockers in the retracted position and the vacuum release valve closed.

Also associated with the proximal end 36 of at least one of the rockers 24 is a valve seat 40 that opens and closes the vacuum release valve 32. The mechanical rockers are spring-loaded to stay in a retracted position during printing operations. This condition is shown in FIG. 4. With the rockers in the retracted state, the spring force rotates the drive rocker 34 such that the valve seat, which is integral with the proximal end of the associated rocker, engages and seals the vacuum release valve. When this valve is opened, air is allowed to enter the vacuum system to substantially equalize pressure above and below the print media, to facilitate removal of the print media 50 from the shuttle plate 16.

Figure 5:
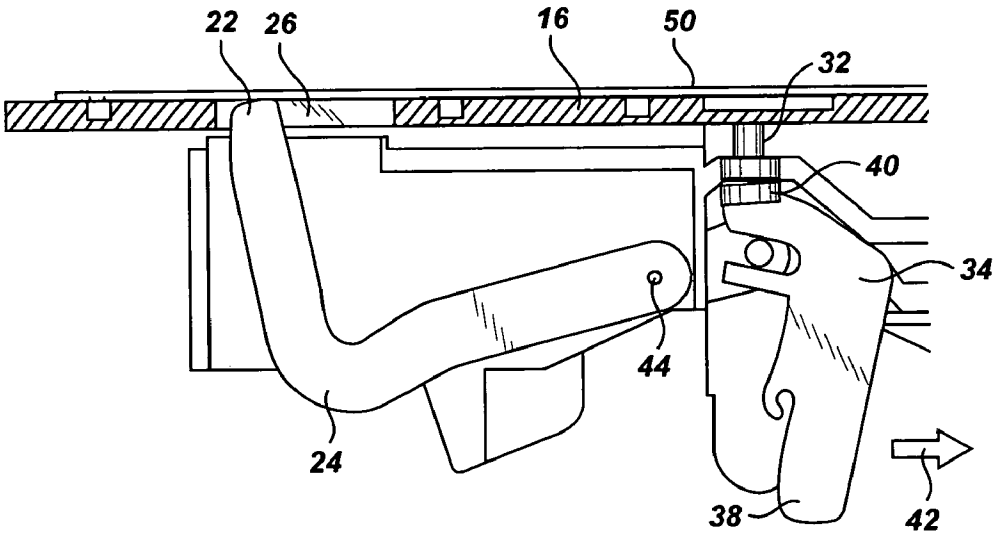
FIG. 5 is a side view of the shuttle plate assembly showing the ejection rockers in a slightly extended position and the vacuum release valve beginning to be cracked open.

Referring to FIG. 5, as the rocker drive mechanism pushes the lever arm 38 of the drive rocker 34 in the direction of arrow 42, the rocker arms 24 are initially rotated so that their distal ends 22 rotate into the rocker apertures 26. As the rockers rotate about their pivot points 44, this motion will cause the valve seat 40 to begin to open. The size (e.g. diameter) of the valve seat is selected to be sufficiently large that vacuum pressure is substantially reduced with a very small valve lift. For example, in one embodiment of an ink jet printing system having a moveable shuttle plate that is approximately 5"×7" (127 mm×177.8 mm) the vacuum system has a volume of about 50 cc. In this system, a vacuum release valve having a diameter of approximately 4 mm has been found sufficient to rapidly discharge the vacuum pressure with a relatively small opening of the valve seat. More specifically, in an embodiment tested by the inventors, the valve will open to about 0.2 mm before the media 50 is engaged by the rocker arms. This opening will allow a flow rate of about 0.3 liter/min. (about 5 cc/sec.), which is sufficient to reduce the manifold vacuum pressure from about 4.3 psi to about 2 psi. This initial pressure reduction is sufficient to reduce the media ejection force by a factor of more than 2.

It should be recognized that valves of various types and configurations can be used for the vacuum release valve. For example, while a linear valve is shown in the figures, a rotary valve or other type of valve could also be used, and mechanically linked to the rocker arms for actuation when the rocker arms move to eject the print media.

Figure 6:
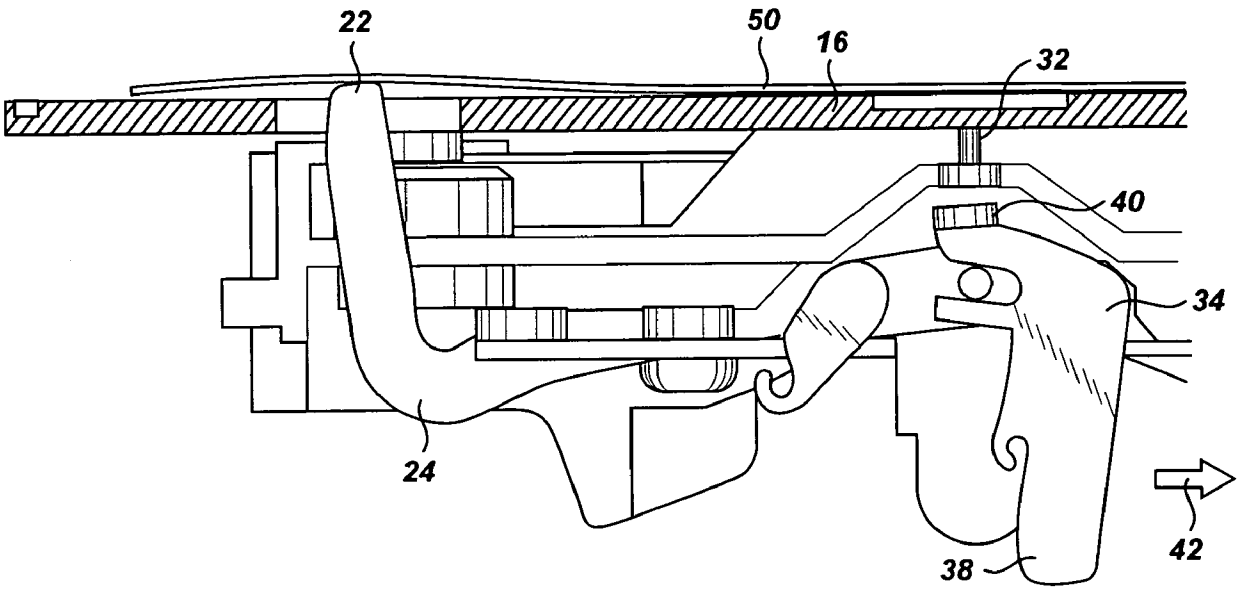
FIG. 6 is a side view of the shuttle plate assembly showing the ejection rockers extended to a position slightly above the top of the shuttle plate and the vacuum release valve fully open.

As the rockers 24 continue to rotate, the vacuum pressure continues to be released, and the rockers begin to lift the media 50 from the shuttle plate 16. This condition is shown in FIG. 6. In the exemplary system discussed above, the rockers will reach the point of media release (i.e. the point at which the media is disengaged from the shuttle plate) when extended about 1 mm above the surface of the shuttle plate. During this initial motion, the valve seat 40 will be opened sufficiently to bleed almost all of the vacuum pressure from the manifold 30. In the example discussed above, as the media begins to be lifted by the rockers just to the point of release, the vacuum pressure will have dropped to about 0.7 psi. The result of this configuration is that the lifting force for lifting the print media is reduced (e.g. from about 135 lbs. to about 20 lbs or less for a piece of 5"×7" media) because the pressure above and below the print media will be substantially equalized. As the term is used herein, a pressure differential of less than about 1 psi between the vacuum system and atmosphere is considered substantially equalized. Altogether, the pressure drop provided by the rocker actuated vacuum system from beginning of motion to the point of release reduces the ejection force by a factor of almost 7. The lower lift force enhances media control (by eliminating or reducing the slingshot effect) and reduces deflection of the rockers and wear on the rockers and the rocker drive mechanism.

Figure 7:
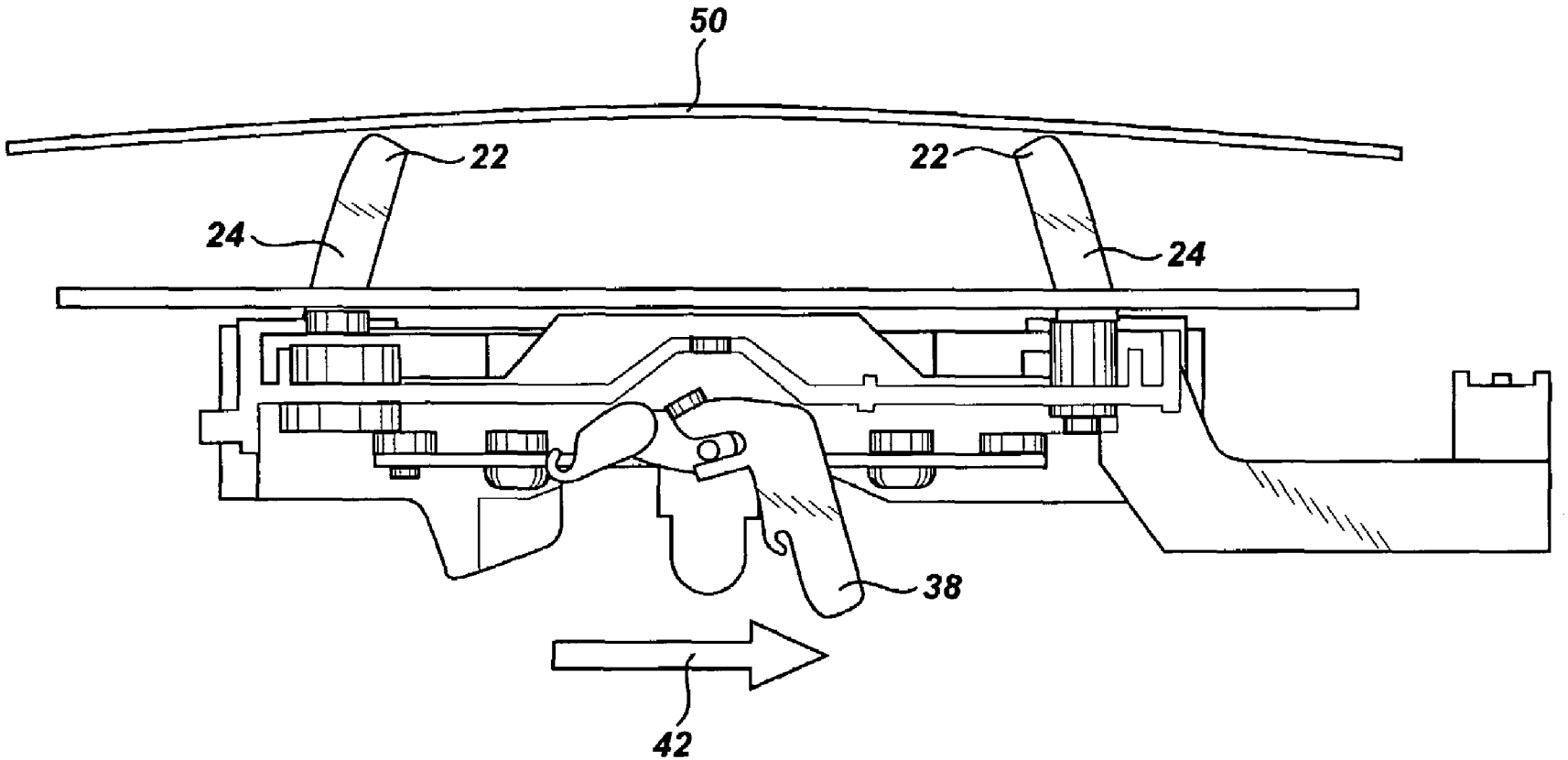
FIG. 7 is a side view of the shuttle plate assembly showing the ejection rockers fully extended and lifting a piece of print media from the shuttle plate.

As the rockers continue to rotate, as shown in FIG. 7, the media can be lifted entirely off of the shuttle plate and placed in position to be transferred to the offloading mechanism (not shown). In one embodiment the rockers are configured to extend about 15 mm above the shuttle plate when fully extended, and lift the media to a position above and substantially parallel to the shuttle plate.

A variety of materials can be used for the various components of this media ejection system. The shuttle plate can be made of aluminum or similarly rigid material to ensure flatness under vacuum pressure. The manifold and rocker arms can be of suitable polymer materials, such as LCP and acetal plastic. The use of polymer materials helps reduce the weight and cost of the system. The vacuum release valve can also be of polymer material. Where vacuum pressures are relatively low, this valve can be configured without a special elastomer seal material if desired. In one embodiment the inventors have used a conical plastic valve seat with no special seal material. Though this configuration can allow a small amount of leakage, this leakage is small compared to the vacuum pump's flowrate capability, and the pump has been sufficient to overcome this leakage. It is anticipated that where higher vacuum pressures are used a special valve seal can also be provided.

This media ejection system and method enables the use of a relatively high amount of hold down vacuum pressure, which improves media hand-off reliability (i.e. the reliability of transferring media to and from the shuttle plate 16). It also provides a "built-in" method of controlling the venting process because the same motion that causes ejection of the print media also vents the vacuum system. There are no additional motions or actuations needed for both of these actions.

The system and method disclosed herein thus simultaneously vents vacuum pressure in a shuttle plate manifold and lifts the media for ejection using a single mechanism. The vacuum release valve is directly mechanically linked with the rockers that eject print media from the moveable shuttle plate in the ink jet printer, so that the mechanical action that lifts the media simultaneously releases the vacuum pressure, thus substantially equalizing pressure above and below the media and reducing the lifting force required. This lower lift force can enhance media control and reduce wear on the rockers and other parts.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A media ejection system for a printer having a stationary print head and a moveable shuttle configured to hold print media via vacuum pressure while moving the print media past the print head, comprising:

a vacuum release valve, actuable to release vacuum pressure in the shuttle; and a lifter, coupled to the vacuum release valve, actuable to mechanically lift the print media from the shuttle, and to simultaneously open the vacuum release valve.

2. A media ejection system in accordance with claim 1, wherein the lifter includes a distal end and a proximal end, the proximal end having a valve seat that is matable with the vacuum release valve, whereby movement of the proximal end operates to open or close the vacuum release valve.

3. A media ejection system in accordance with claim 1, wherein the lifter comprises a pivoting rocker arm, and further comprising a drive rocker, pivotally coupled to a proximal end of the rocker arm, actuable to apply a driving force to the proximal end of the rocker arm to thereby cause motion of a distal end of the rocker arm.

4. A media ejection system in accordance with claim 1, wherein the lifter is moveable between a fully retracted position, at which the vacuum release valve is closed, and an extended position, at which the vacuum release valve is open and a distal end of the rocker is extended to lift the print media above the shuttle.

5. A media ejection system in accordance with claim 4, wherein the vacuum release valve is actuable to open to release vacuum pressure when the lifter is extended to lift the print media by about 1 mm above the shuttle.

6. A media ejection system in accordance with claim 5, wherein the vacuum release valve has a diameter of about 4 mm.

7. A media ejection system in accordance with claim 1, wherein the shuttle further comprises:

a shuttle plate, having a surface for directly supporting the print media;

a manifold, located below the shuttle plate; and a plurality of vacuum passageways, communicating between the manifold and the shuttle plate, and between the manifold and the vacuum release valve.

8. A media ejection system in accordance with claim 7, wherein the shuttle plate is at least as large as media of about 5"×7" in size.

9. A media ejection system in accordance with claim 8, wherein the vacuum release valve reduces vacuum pressure to less than about 1 psi when the lifter has extended about 1 mm above the shuttle plate.

10. A media ejection system in accordance with claim 1, wherein the lifter comprises four lifters, each having a distal end that is extensible through an aperture in the shuttle plate.

11. A media ejection system for a printer having a stationary print head and a moveable shuttle configured to hold print media via vacuum pressure while moving the print media past the print head, comprising:

means for simultaneously ejecting print media from the shuttle plate and substantially equalizing pressure above and below the print media.

12. A media ejection system in accordance with claim 11, wherein the means for simultaneously ejecting print media from the shuttle plate and substantially equalizing pressure above and below the print media comprises:

a mechanical lifter, actuable to lift print media off of the shuttle; and a vacuum release valve, coupled to the lifter, whereby motion of the lifter to lift the print media opens the release valve to release vacuum pressure maintained in the shuttle below the print media.

13. A media ejection system in accordance with claim 12, wherein the lifter comprises a mechanical rocker that is pivotal about a pivot point, and further comprising a valve seat, connected to the rocker and moveable with pivoting of the rocker to open the vacuum release valve when the rocker rotates to lift the print media.

14. A media ejection system in accordance with claim 12, wherein the vacuum release valve reduces vacuum pressure to less than about 1 psi when the lifter has extended no more than about 1 mm above the shuttle plate.

15. A media ejection system in accordance with claim 11, wherein the means for simultaneously ejecting print media from the shuttle plate and substantially equalizing pressure above and below the print media further comprises:

means for lifting a substantially planar sheet of media from a substantially planar shuttle plate to a position above and substantially parallel to the shuttle plate; and means for releasing vacuum pressure in the shuttle.

16. A method for ejecting print media from a moveable shuttle configured to hold print media on a shuttle plate via vacuum pressure while moving the print media past a stationary print head of an ink jet printer, comprising the steps of:

mechanically lifting the print media from the shuttle; and simultaneously substantially equalizing pressure above and below the print media by opening a vacuum release valve to release vacuum pressure within the shuttle plate below the print media.

17. A method in accordance with claim 16, wherein the step of mechanically lifting the print media from the shuttle comprises lifting a sheet of media to a position above and substantially parallel to the shuttle plate.

18. A method in accordance with claim 16, wherein the step of mechanically lifting the print media from the shuttle comprises rotating a rocker arm from a retracted position below the shuttle plate to an extended position wherein the rocker arm is extended above the shuttle plate through a rocker aperture therein.

19. A method in accordance with claim 16, wherein the step of substantially equalizing pressure above and below the print media is substantially completed before the print media is lifted more than about 1 mm above the shuttle plate.

* * * * *